US005626543A

United States Patent [19]

Chen

[11] Patent Number: 5,626,543

[45] Date of Patent: May 6, 1997

[54] BELLOWS-LIKE EXERCISER

[76] Inventor: Ping Chen, No. 20, Nan-Mei St., Taichung City, Taiwan

[21] Appl. No.: 627,890

[22] Filed: Apr. 3, 1996

[51] Int. Cl.[6] ..... A63B 21/008

[52] U.S. Cl. ..... 482/112

[58] Field of Search ..... 482/112, 111; 251/117, 309, 310; 267/123, 64.27, 64.12

[56] References Cited

U.S. PATENT DOCUMENTS

| | | | |
|---|---|---|---|
| 3,588,076 | 6/1971 | Ammerman | 267/64.27 |
| 3,836,141 | 9/1974 | Franklyn | 482/112 |
| 3,884,463 | 5/1975 | Malatesta | 482/112 |
| 4,248,463 | 2/1981 | Salazar | 482/112 |
| 4,635,931 | 1/1987 | Brannstam | 482/112 |
| 5,346,444 | 9/1994 | Hsieh | 482/112 |

FOREIGN PATENT DOCUMENTS

| | | | |
|---|---|---|---|
| 5588076 | 10/1956 | Italy | 251/310 |

*Primary Examiner*—Richard J. Apley
*Assistant Examiner*—William LaMarca
*Attorney, Agent, or Firm*—Ladas & Parry

[57] ABSTRACT

An exerciser includes a bellows and a pair of gripping units attached to the bellows. The bellows includes an elongated wall body which is made from a compressible and expandable resilient material and which defines a sealed interior chamber therein. The wall body has a first end portion, a second end portion and a plurality of pleated sections located between and formed integrally with the end portions thereof. The first end portion has a radially extending circular orifice which is formed through a wall thereof and which has a predetermined diameter for communicating an exterior of the wall body with the interior chamber thereof so as to permit air to enter into and exit from the interior chamber only via the orifice. The gripping units are respectively attached to the first and second end portions of the wall body such that the wall body can be compressed or stretched by applying a force on the first and second end portions so as to vary the volume of the chamber in the wall body, thereby enabling the user to achieve an alternate pull and push exercising effects on a user.

1 Claim, 9 Drawing Sheets

BELLOWS-LIKE EXERCISER

BACKGROUND OF THE INVENTION

1. Field of the Invention

The invention relates to an exerciser, more particularly to a bellows-like exerciser.

2. Description of the Related Art

The invention is an improvement over a spring-type exerciser which includes compression springs or tension springs whereby after holding two ends of the exerciser, the user can pull the ends away from each other or push the ends toward each other so as to achieve an exercising effect. A disadvantage of the above-mentioned exerciser resides in that the compression-spring type exerciser permits the user to effect only a pushing action, while the tension-spring type exerciser permits the user to effect only a pulling action.

SUMMARY OF THE INVENTION

The object of this invention is to provide an exerciser which allows both hands of the user to pull and push two ends of the exerciser alternately so as to achieve an exercising effect.

Accordingly, the exerciser of this invention includes a bellows and a pair of gripping units attached to the bellows. The bellows includes an elongated wall body which is made from a compressible and expandable resilient material and which defines a sealed interior chamber therein. The wall body has a first end portion, a second end portion and a plurality of pleated sections located between and formed integrally with the end portions thereof. The first end portion has a radially extending circular orifice which is formed through a wall thereof and which has a predetermined diameter for communicating an exterior of the wall body with the interior chamber thereof so as to permit air to enter into and exit from the interior chamber only via the orifice. The gripping units are attached respectively to the first and second end portions of the wall body such that the wall body can be compressed or stretched by applying a force on the first and second end portions so as to the vary the volume of the interior chamber in the wall body, thereby enabling the user to achieve an alternate pull and push exercising effect.

BRIEF DESCRIPTION OF THE DRAWINGS

Other features and advantages of this invention will become more apparent in the following detailed description of the preferred embodiments with reference to the accompanying drawings, in which.

DETAILED DESCRIPTION OF THE PREFERRED EMBODIMENTS

Figure 1:
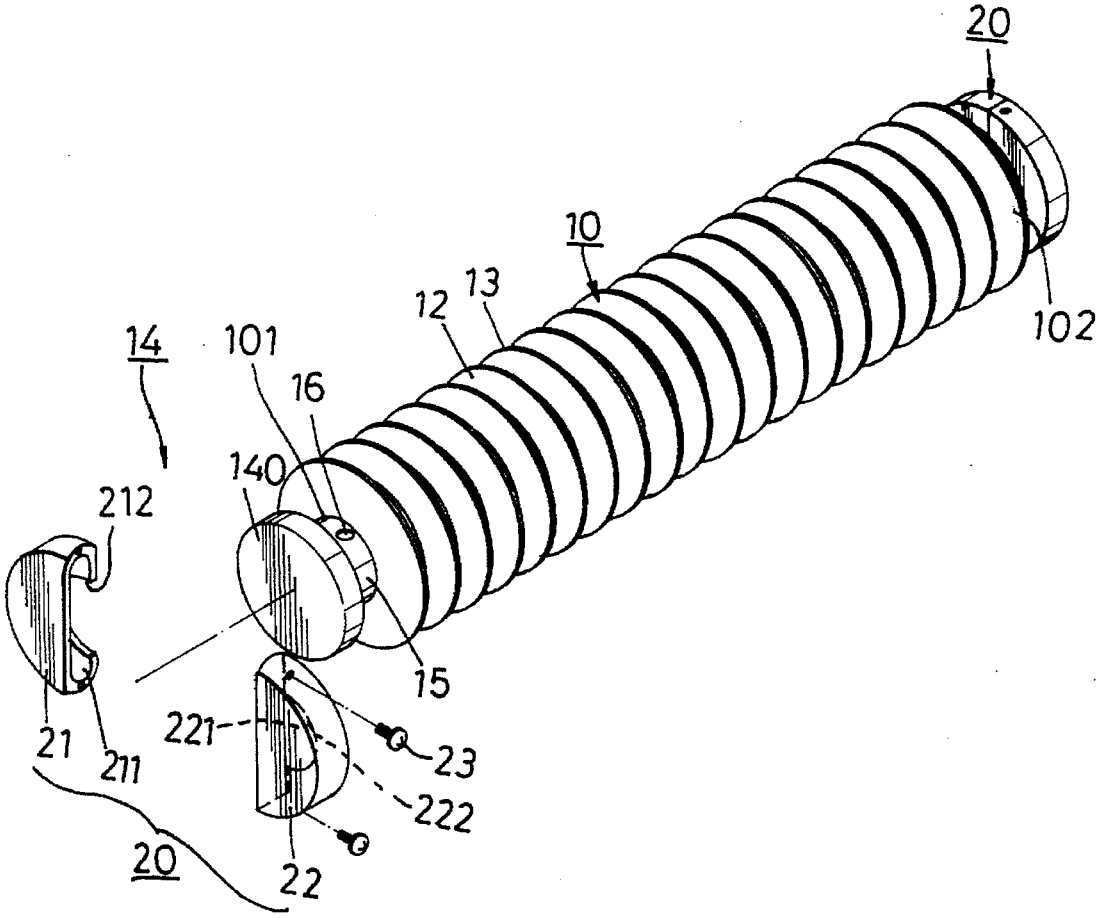
FIG. 1 is a perspective view of a first preferred embodiment of a bellows-like exerciser of this invention, in which a gripping unit is removed from one end portion of the exerciser for clarity.
Figure 2:
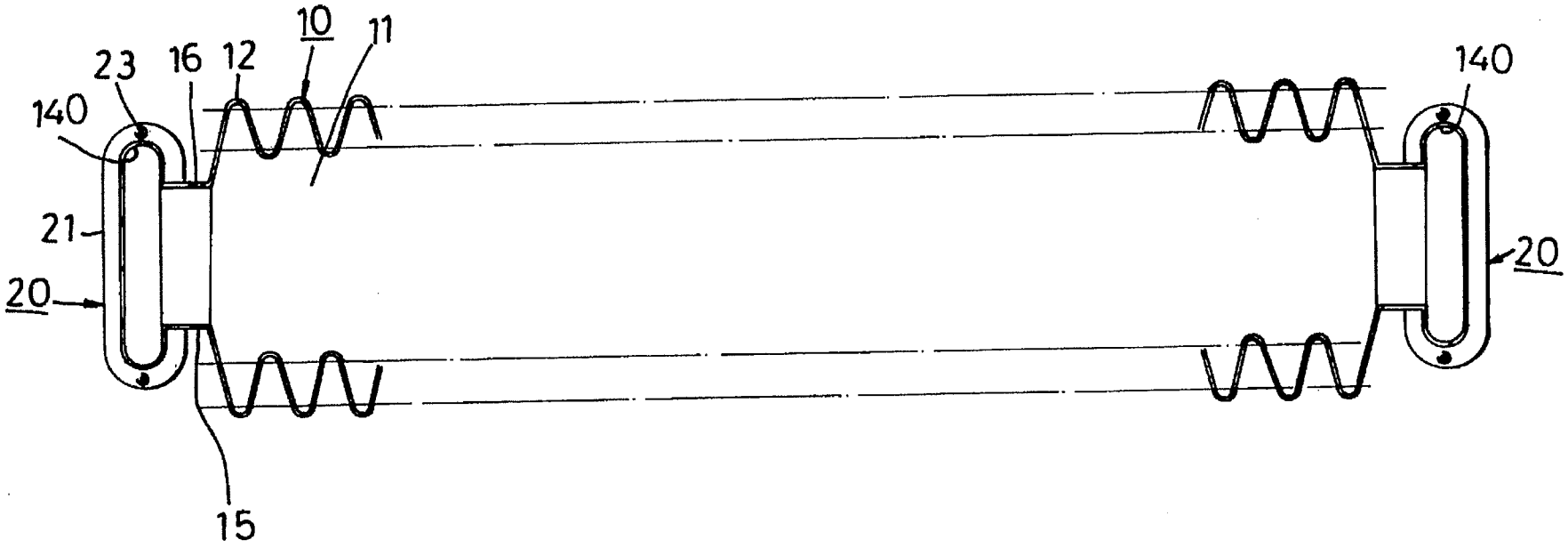
FIG. 2 illustrates the bellows-like exerciser of this invention.
Figure 3:
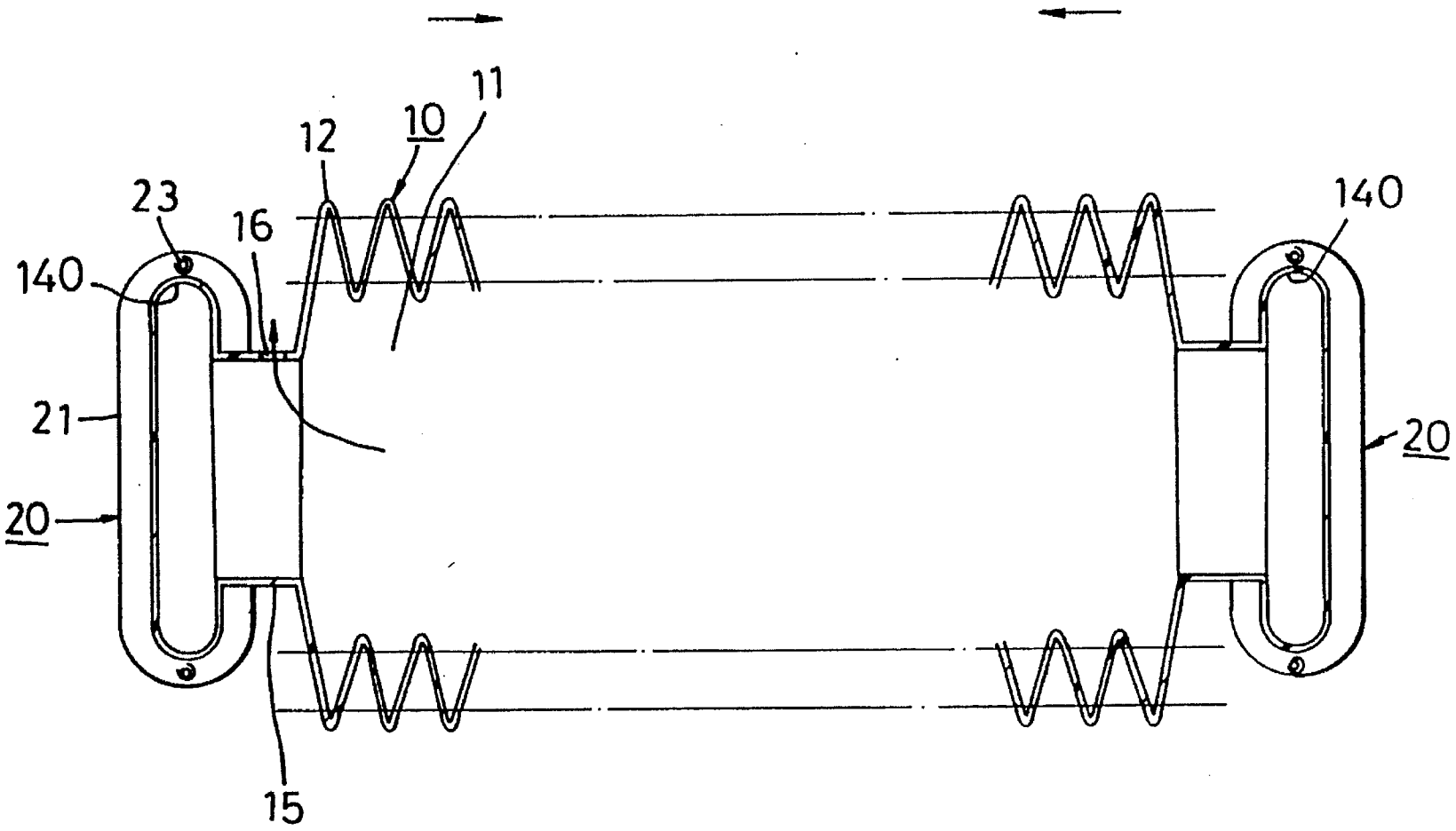
FIG. 3 illustrates how the bellows-like exerciser of this invention functions when in use.

Referring to FIGS. 1 to 3, the first preferred embodiment of a bellows-like exerciser of this invention is shown to include a bellows and a pair of gripping units 14 attached to the end portions of the bellows.

As illustrated, the bellows includes an elongated wall body 10 which is made from a compressible and expandable resilient material and which defines a sealed interior chamber 11 therein. The wall body 10 has a first end portion 101, a second end portion 102, and a plurality of pleated sections 12 located between the end portions 101, 102. Each of the gripping units 14 includes a generally mushroom-shaped member 140 which is smaller in diameter than the end portions 101, 102 and which is integrally formed with the outer end of the corresponding end portion 101, 102. The first end portion 101 of the wall body 10 has a radially extending circular orifice 16 which is formed through a wall 15 thereof and which is provided with a predetermined diameter for communicating an exterior of the wall body 10 with the interior chamber 11 so as to permit air to enter into and exit from the interior chamber 11 only via the orifice 16.

Each of the gripping units 14 further includes a cover 20 attached to the first and second end portions 101, 102 of the wall body 10 via the mushroom-shaped members 140. Each of the covers 20 consists of first and second halves 21, 22 which are coupled together by means of screws 23. The halves 21, 22 have two flanges 212, 222 which cooperatively define receiving spaces 211, 221 within which the mushroom-shaped members 140 are received.

As best illustrated in FIG. 3, in use, the user can hold the covers 20 such that the wall body 10 can be compressed or stretched by applying a force on the first and second end portions 101, 102 (see FIG. 1) so as to vary the volume of the interior chamber 11 in the wall body 10, thereby enabling the user to achieve an alternate pull and push exercising effect.

Figure 4:
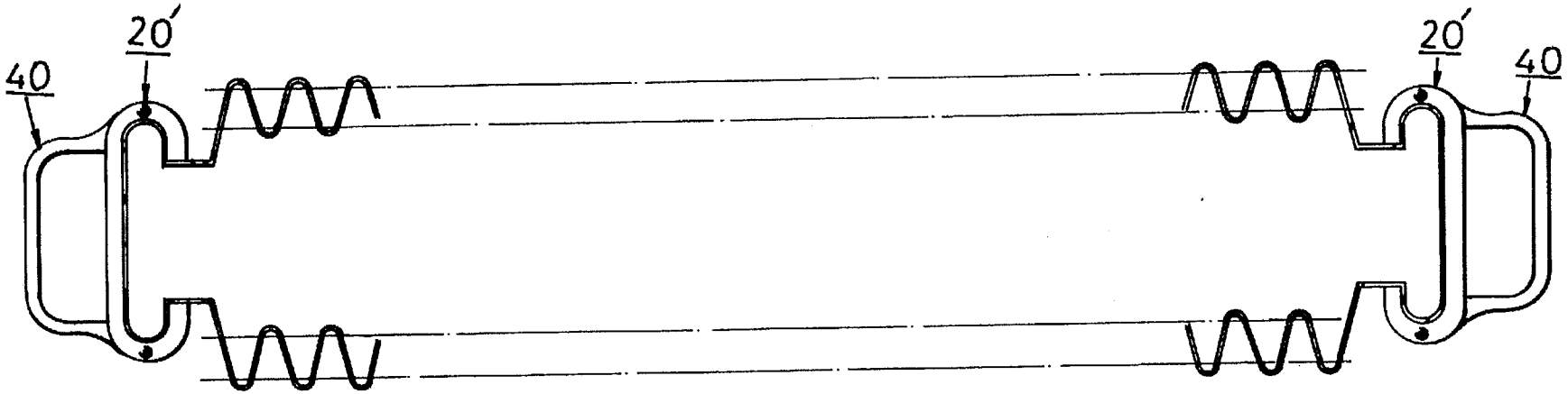
FIG. 4 illustrates a second preferred embodiment of this invention.

Referring to FIG. 4, the second preferred embodiment of this invention is shown to be similar to the first embodiment in construction, except that two handles 40 are attached on the covers 20', respectively.

Figure 5:
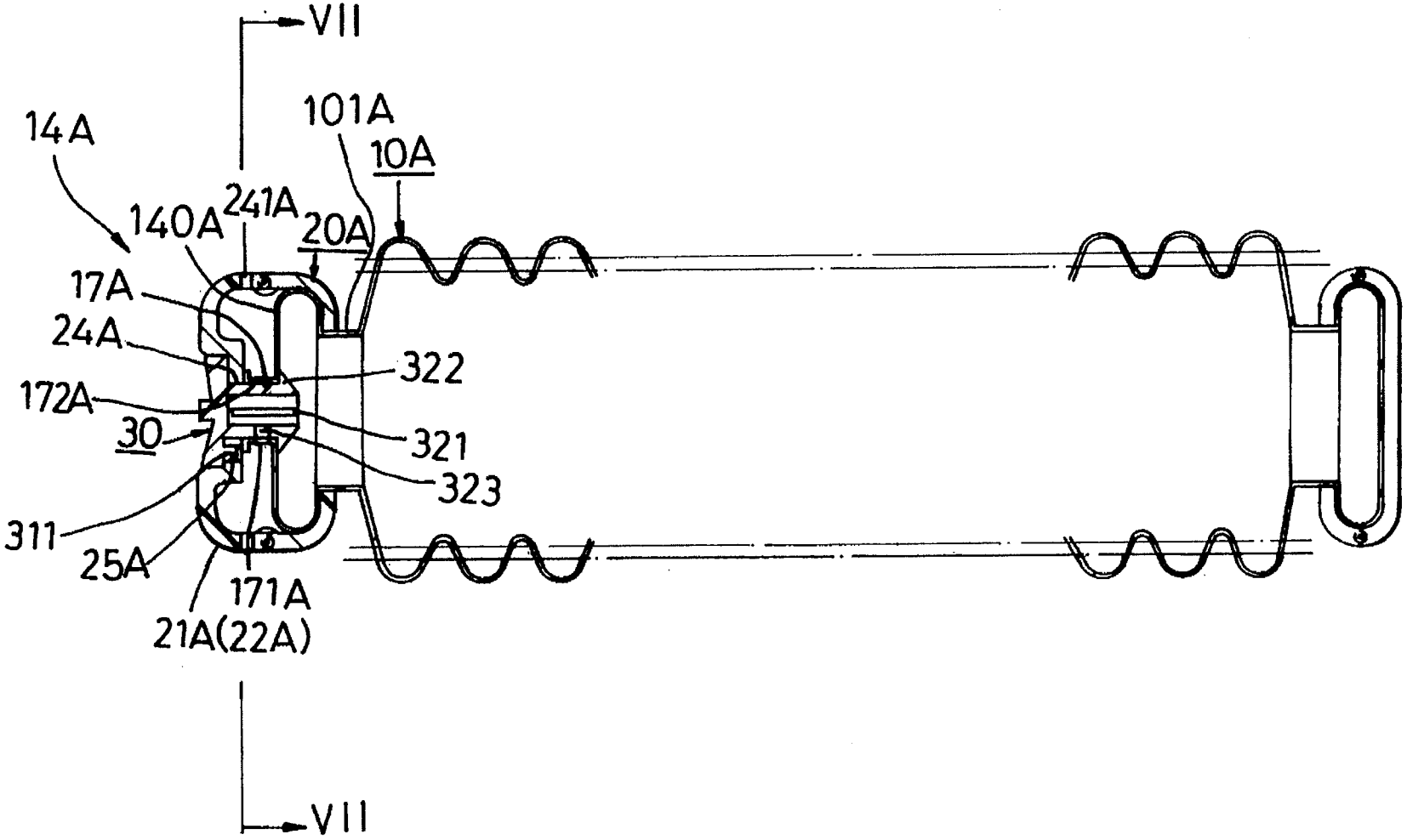
FIG. 5 illustrates a third preferred embodiment of this invention.
Figure 6:
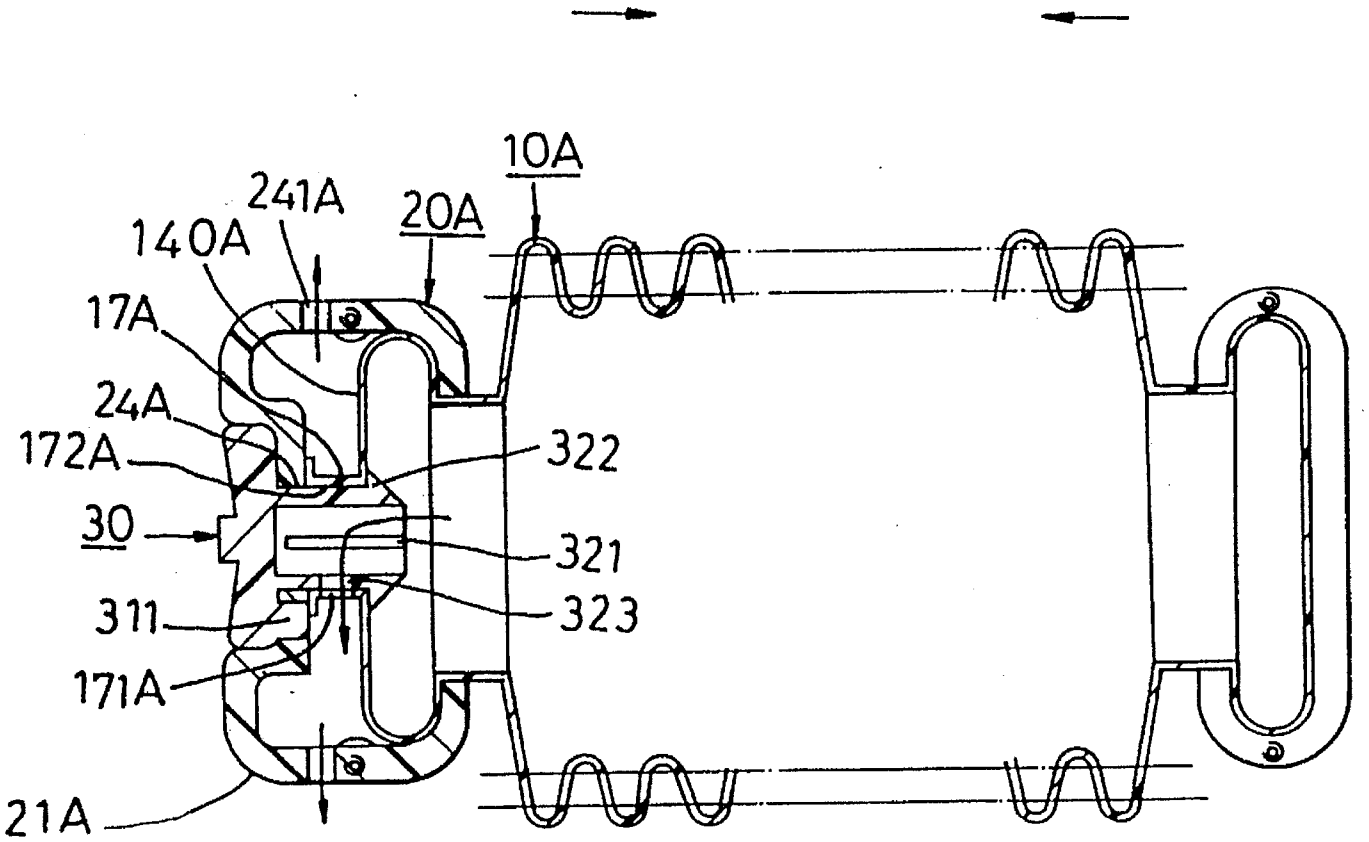
FIG. 6 illustrates how the third preferred embodiment of this invention functions when in use.

Referring to FIGS. 5 and 6, the third preferred embodiment of this invention is shown to be generally similar to the first preferred embodiment in construction. In this embodiment, however, a mushroom-shaped member 140A is integrally formed with the first end portion 101A of the wall body 10A and has an axial extension 17A with a hole 172A that is in communication with the interior chamber of the wall body 10A. An orifice 171A is formed through a wall section defining the axial extension 17A of the mushroom-shaped member 140A. A cover 20A is attached to the member 140A and consists of an outer half 21A and an inner half 22A. The outer half 21A of the cover 20A has two opposite radial holes 241A, a central opening 24A in communication with the hole 172A of the member 140A, and a curved circumferentially extending guide slot 25A formed therein. The left gripping unit 14A further includes a flexible tubular adjustment plug 30 press-fitted into the axial extension 17A of the mushroom-shaped member 140A via the opening 24A of the cover 20 so that a mushroom-like distal end 322 of the plug 30 is confined in the member 140A, thereby preventing disengagement of the plug 30 from the member 140A. The adjustment plug 30 has an axially extending blind hole 321 formed in an end face thereof, and a radial adjustment hole 323 which is formed through a wall defining the plug 30. The hole 323 is in communication with the hole 321 and is aligned with the orifice 171A. The adjustment plug 30 further includes a guide tongue 311 which projects axially and inwardly therefrom and which engages the guide slot 25A in such a manner that the tongue 311 is confined in the slot 25A of the cover 20.

Figure 7:
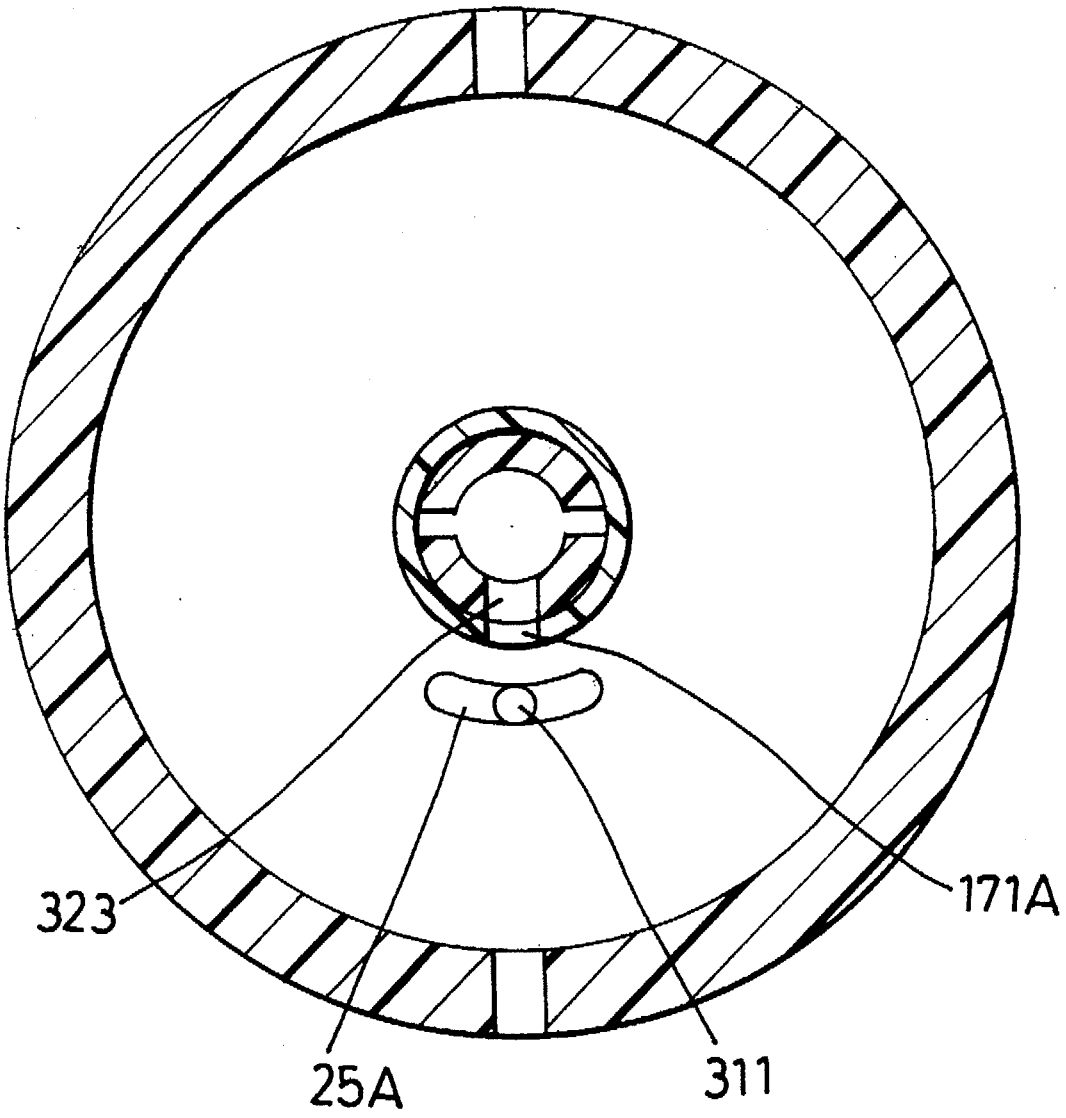
FIG. 7 is a sectional view of the third preferred embodiment taken along line VII—VII in FIG. 5, illustrating how the bellow-like exerciser functions so that the least force can be applied on two end portions thereof.
Figure 8:
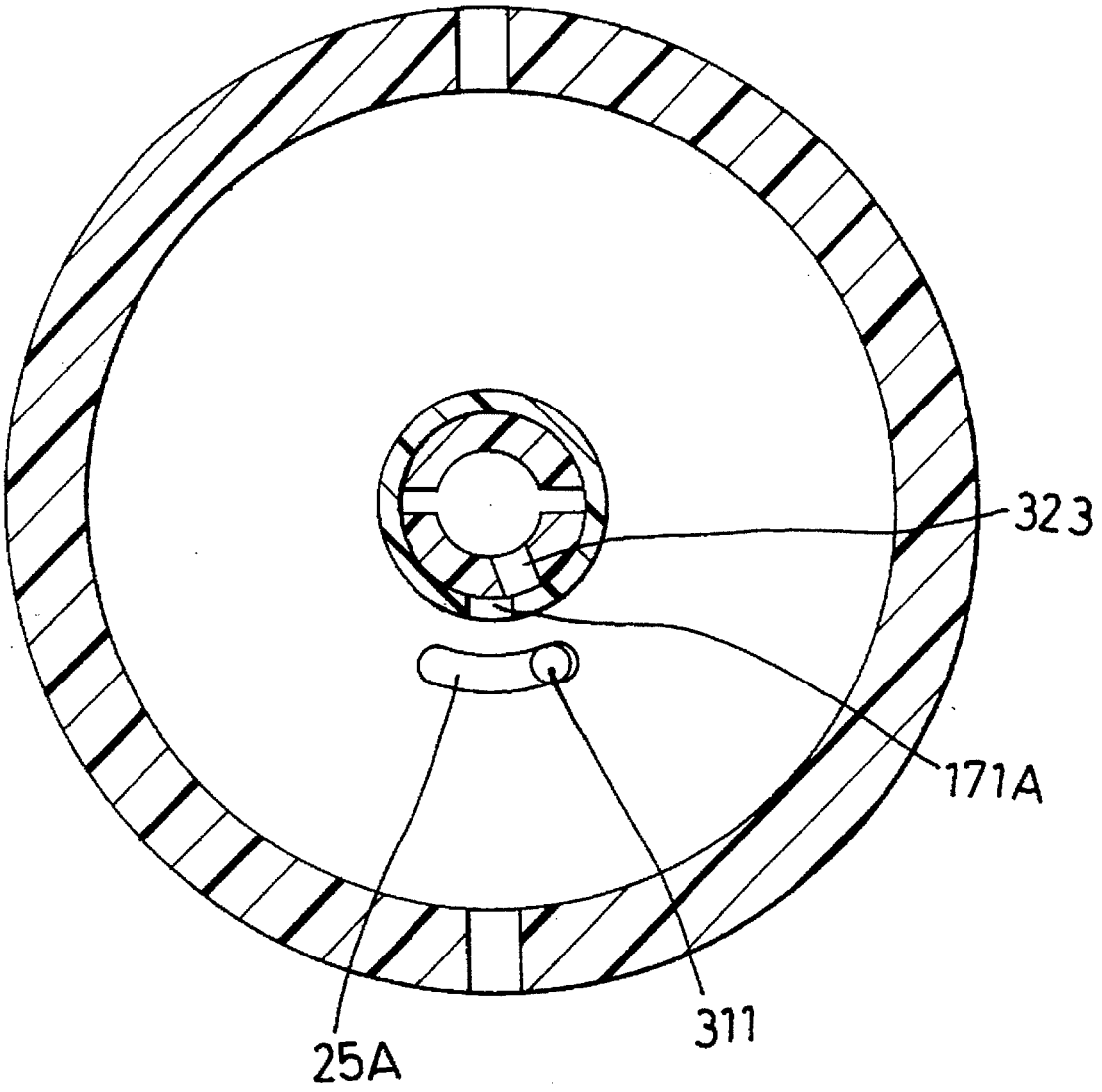
FIG. 8 is a sectional view of the third preferred embodiment, illustrating how the exerciser is adjusted so that a greater force must be applied on two end portions thereof.
Figure 9:
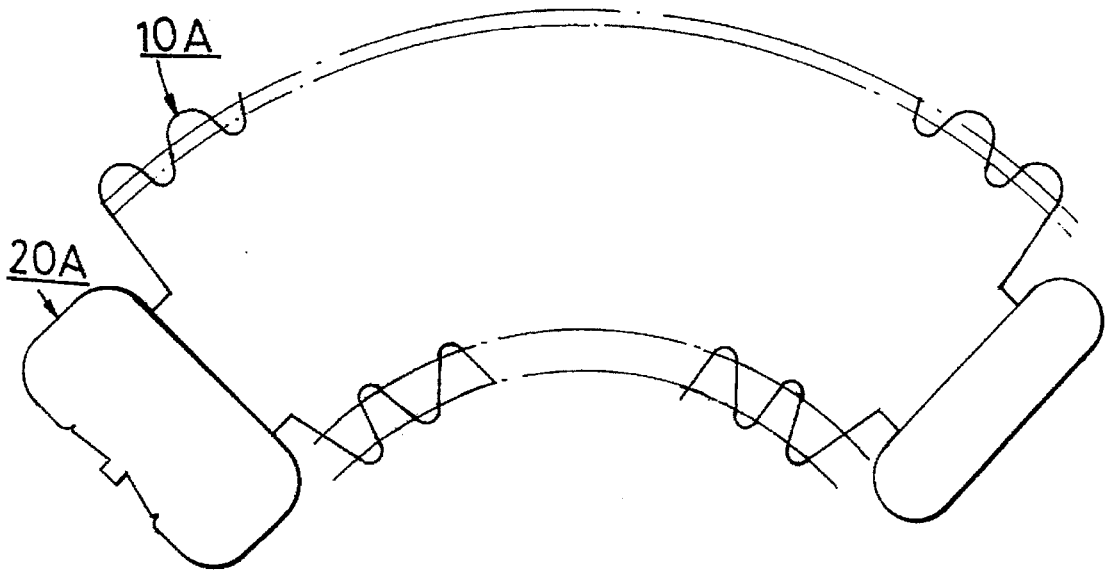
FIG. 9 illustrates how the third preferred embodiment of this invention functions in another way when in use.

As shown in FIGS. 7 and 8, when the guide tongue 311 of the adjustment plug 30 is at the middle of the guide slot 25A so that the orifice 171A and the adjustment hole 323 are aligned with one another, the user need only apply the least force on the two covers so as to operate the exerciser. As illustrated, rotation of the adjustment plug 30 on the cover moves the guide tongue 311 in the slot 25A so as to register the adjustment hole 323 with at least a portion of the orifice 171A (see FIG. 7), thereby reducing flow rate of air between the adjustment hole 323 and the orifice 171A. Under this condition, the user must apply a greater force on the cover 20A (see FIG. 9) in order to operate the exerciser. In this way, the guide tongue 311 of the adjustment plug 30 can be moved from the position of FIG. 7 to the left or right to any position so as to deflect a portion of the adjustment hole 323 from the orifice 171A and so as to adjust the force that is needed to operate the exerciser.

With this invention thus explained, it is obvious to those skilled in the art that various modifications and variations can be made without departing from the scope and spirit thereof. It is therefore intended that this invention be limited only as in the appended claims.

I claim:

1. An exerciser comprising a bellows including an elongated wall body made from a pressible and expandable resilient material and defining a sealed interior chamber therein, said wall body having a first end portion, a second end portion and a plurality of pleated sections located between and integrally formed with said first and second end portions, said first end portion having an axially extending hole formed therethrough and a radially extending circular orifice which is formed through a wall thereof and which has a predetermined diameter for communicating an exterior of said wall body with said interior chamber thereof, so as to permit air to enter into and exit from said interior chamber only via said orifice; and a pair of gripping units respectively attached to said first and second end portions of said wall body such that said wall body can be compressed or stretched by applying a force on said first and second end portions so as to vary volume of said chamber in said wall body, thereby enabling a user to achieve an alternate pull and push exercising effect, wherein each of said gripping units includes a tubular adjustment plug that is press-fitted into said axially extending hole of said first end portion and that has a radially extending adjustment hole which is formed through a wall of said plug and which is adjacent to and aligned with said orifice of said first end portion of said wall body, said plug being capable of being rotated within said wall body so as to deflect a portion of said adjustment hole from said orifice, thereby reducing flow rate of air between said adjustment hole and said orifice, and wherein each of said gripping units includes a cover attached to a corresponding one of said first and second end portions of said wall body, one of said covers being attached to said first end portion and having a curved circumferentially extending guide slot formed therein, said plug including guide tongue projecting axially and inwardly therefrom to engage said guide slot so as to confine said tongue in said slot, rotation of said plug relative to said wall body moving said tongue in said slot, engagement of said tongue in said slot registering said adjustment hole with at least a portion of said orifice.

* * * * *